United States Patent [19]

Metoff

[11] 4,454,451

[45] Jun. 12, 1984

[54] CIRCULAR FLUORESCENT LAMP UNIT

[75] Inventor: Rudolph Metoff, Mayfield Heights, Ohio

[73] Assignee: General Electric Company, Schenectady, N.Y.

[21] Appl. No.: 333,199

[22] Filed: Dec. 21, 1981

[51] Int. Cl.[3] ..... H01J 5/50

[52] U.S. Cl. ..... 315/58; 313/49; 313/50; 362/216

[58] Field of Search ..... 315/58, 62; 313/49, 313/50, 51; 362/225, 370, 368, 391, 216, 448, 220; 339/50 C, 59 L, 62, 59 R, 61 R

[56] References Cited

U.S. PATENT DOCUMENTS

| | | | |
|---|---|---|---|
| 2,534,956 | 12/1950 | Pistey et al. | 339/50 C X |
| 2,697,777 | 12/1954 | Rosa | 362/216 |
| 2,878,372 | 3/1959 | Fry | 362/216 |
| 3,059,137 | 10/1962 | Reaves | 313/204 |
| 4,105,276 | 8/1978 | Miller | 339/50 C X |
| 4,161,020 | 7/1979 | Miller | 362/216 |
| 4,258,287 | 3/1981 | Hetzel | 315/58 |
| 4,278,911 | 7/1981 | Metoff | 313/318 |

FOREIGN PATENT DOCUMENTS

| | | | |
|---|---|---|---|
| 1956900 | 5/1971 | Fed. Rep. of Germany | 362/216 |
| 578155 | 6/1958 | Italy | 362/216 |
| 710824 | 6/1954 | United Kingdom | 362/216 |

*Primary Examiner*—Eugene R. Laroche
*Assistant Examiner*—Vincent De Luca
*Attorney, Agent, or Firm*—Philip L. Schlamp; Fred Jacob

[57] ABSTRACT

A circular fluorescent lamp unit having a central screw-in hub containing lamp ballast means, a plurality of support arms extending from the hub to support a circular lamp, and an elongated flexible electrical connector member locked to and extending from the hub substantially alongside one of said support arms and having socket means for connection to a base member of the lamp. The connector member contains electrical connection wires and has a rectangular cross-section shape to facilitate its bending for connecting its socket means to, or disconnecting it from, the lamp base member.

3 Claims, 3 Drawing Figures

CIRCULAR FLUORESCENT LAMP UNITCL

CROSS-REFERENCE TO RELATED APPLICATION

Ser. No. 333,200, Martin J. Graf, Frederick Hetzel, and Douglas Seredich, "Circular Fluorescent Lamp Unit", filed concurrently herewith and assigned the same as this invention.

BACKGROUND OF THE INVENTION

The invention is in the field of circular lamp units, such as screw-in units having a circular fluorescent lamp and a ballast.

Various types of screw-in fluorescent lamp units have been devised, for taking the place of incandescent lamps in ceiling sockets and in table lamps and floor lamps, and are economical to operate and conserve electrical energy because they consume less than half the electrical energy consumed by incandescent lamps for the same brightness. U.S. Pat. No. 4,258,287 to Frederick Hetzel and U.S. Pat. No. 4,278,911 to Rudolph Metoff each discloses a screw-in central hub containing a ballast, and a replaceable circular lamp assembly positioned on the hub. The connector wires for the lamp are contained in a spoke that is an integral unit with the lamp bulb. U.S. Pat. No. 4,161,020 to Miller discloses a circular lamp unit having a rigid socket on the hub for connection to a circular lamp bulb, and U.S. Pat. No. 3,059,137 to Reaves discloses a circular lamp unit have a bundle of wires extending from a central ballast unit for connection to a circular lamp.

SUMMARY OF THE INVENTION

Objects of the invention are to provide an improved circular lamp unit which is attractive in appearance, economical to manufacture, and which uses easily replaceable circular fluorescent light bulbs.

The invention comprises, briefly and in a preferred embodiment, a circular fluorescent lamp unit having a central screw-in hub containing lamp ballast means, a plurality of support arms extending from the hub to support a circular lamp, and an elongated flexible electrical connector member mechanically locked to and extending from the hub substantially alongside one of said support arms and having socket means for connection to a base member of the lamp. The connector member contains electrical connection wires and has a rectangular cross-section shape to facilitate its bending in a direction for connecting its socket means to, or disconnecting it from, the lamp base member.

DESCRIPTION OF THE PREFERRED EMBODIMENT

Figure 1:
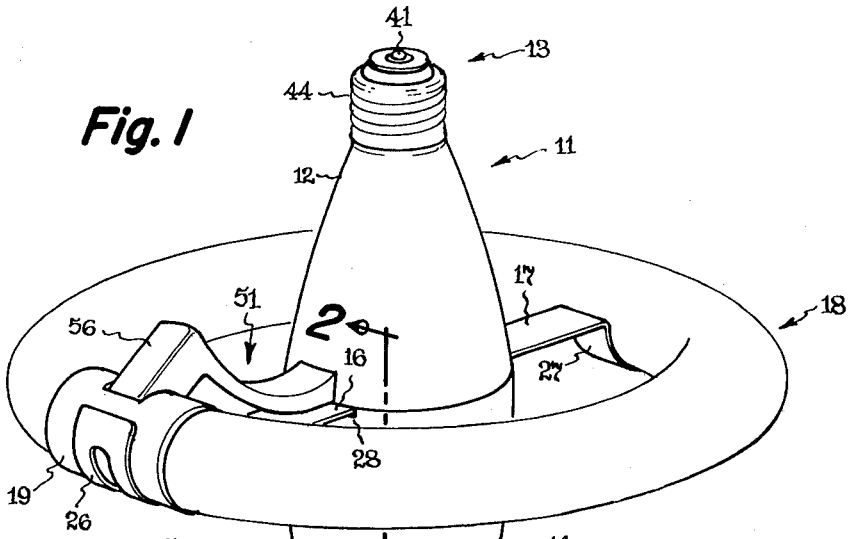
FIG. 1 is a perspective view of a preferred embodiment of the invention, showing a lamp unit having an electrical connector member connected to a circular light bulb.
Figure 2:
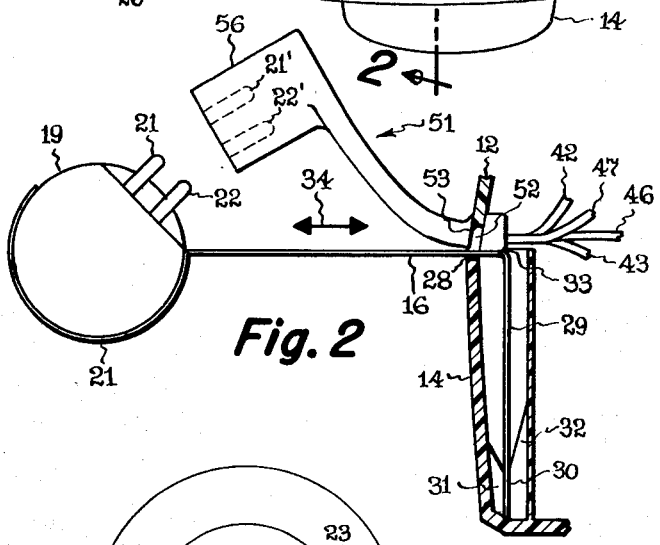
FIG. 2 is a side sectional view of a portion of FIG. 1, taken on the line 2—2 thereof, showing the electrical connector member disconnected from the light bulb.

The circular lamp unit comprises a central hub 11 having a two-part plastic housing consisting of a tapered section 12 having a threaded screw base 13 attached to the small end thereof and adapted to fit household or other threaded sockets, and a cylindrical cap section 14 attached to the section 12 by suitable means such as is disclosed in the above-referenced Hetzel patent. The hub 11 is hollow and contains a ballast and starter switch, as will be described.

A pair of light bulb support arms 16, 17 of sheet metal extend laterally from the hub 11 at mutually opposite sides thereof, and support and hold in position a circular light bulb 18. The light bulb 18 is provided with a conventional four-pin connector base plug 19 having pairs of connector pins 21, 22 connected respectively to ends of cathodes 23, 24 contained in the lamp 18. The outer end regions 26, 27 of the support arms 16,17 are curved to partly surround and snugly and resiliently hold the lamp 18, one of these end regions 26 being at and partly around the lamp plug 19. The lamp 18 thus is removable from and replaceable in the support arm end regions 26, 27. To facilitate this, one or both of the support arms 16, 17 extends through slots 28 in the wall of the hub cap 14 and are held in the hub cap 14 by a bent inner region 29 of which the outer end 30 is fixedly supported in position by ribs 31, 32 of the cap 14, and the portion of the region 29 near the bend 33 is free to move so that the arm 16 (and/or arm 17) is slidable in and out from the hub 11 a short distance, such as about an eighth or a quarter of an inch, as indicated by the double arrow 34, so that the support arms can readily adjust in length to accommodate and hold circular lamps 18 of slightly varying diameters such as due to manufacturing tolerance variations. This arrangement is disclosed and claimed in the above-referenced patent application.

The hub 11 contains a conventional lamp ballast means 36, such as an inductor, resistor or capacitor, and may also contain a conventional glow starter switch 37 which alternatively may be contained within the lamp connector plug 19. An end of the ballest 36 is connected to the button contact 41 of base 13, and the other end thereof is electrically connected, via a wire 42, to the connector terminal 22 of cathode 23. Another wire 43 connects the threaded shell 44 of base 13 to the connector terminal 22 of cathode 24, and wires 46 and 47 respectively connect the starter switch 37 across the connector terminals 21 of cathodes 23 and 24.

Figure 3:
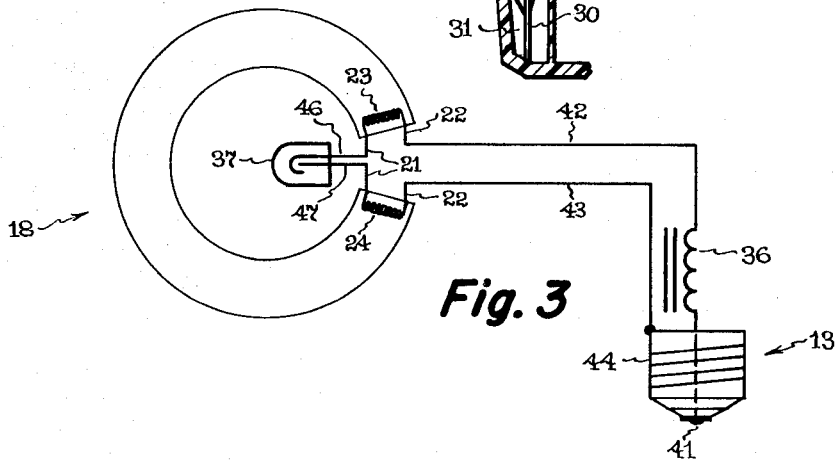
FIG. 3 is an electrical circuit diagram of the lamp unit.

In accordance with the present invention, the connector wires 42, 43, 46 and 47 are carried by and/or embedded in, and are a part of, an elongated resilient electrical connector member 51 preferably of rubber or plastic and having a lateral groove 52 near an end thereof which fits into a slot 53 of the hub 11 and thus locks the connector member to the hub, with the connection wires 42, 43, 46 and 47 extending from the inner end of the connector member and into the hub for connection to the ballast 36 and starter switch 37. The hub locking slot 53 is located in the tapered hub section 12 adjacent to the flat side of support arm 16 so that the connector 51 is in alignment with and extends substantially along the support arm 16. The connector member 51 includes an angular socket portion 56 at its outer end and which contains two pairs of connector receptacles 21' and 22' adapted to connect over the lamp plug pairs of terminals 21, 22 when the socket portion 56 is pushed over these terminals, to provide an operative lamp circuit as shown in FIG. 3, the pairs of connector receptacles 21', 22' being suitably connected to the ends of the wires 42, 43, 46, and 47 within the socket portion 56. The lamp 18 is easily replaceable by pulling the connector socket 56 from the lamp and removing the lamp from its support arms 16, 17. The hub and ballast unit outlasts the lives of several light bulbs. To facilitate the bending of the connector member 51 when connecting it to or disconnecting it from a lamp, its cross-section is preferably rectangular with its narrower dimension in the direction of its flexing, as shown in the drawing, thus making is more flexible and easier to bend when connecting and disconnecting lamps, and also making it relatively inflexible laterally thus keeping it in alignment with the lamp plug 19. The width or larger cross-section dimension of the connector 51 may be approximately the same as that of the support arm 16. The connector member 51, being resilient, stays substantially in position and is easier to use than a relative floppy bundle of flexible connector wires, and is less likely to cause breaking of the light bulb or its connector plug than a rigid socket on the ballast hub.

The invention provides a connector member 51 which is easy to use, economical to manufacture, which covers and protects the connector wires, and which is unobtrusive and neat in appearance.

While preferred embodiments and modifications of the invention have been shown and described, various other embodiments and modifications thereof will become apparent to persons skilled in the art and will fall within the scope of the invention as defined in the following claims.

What I claim as new and desired to secure by U.S. Letters of Patent is:

1. A circular flourescent lamp unit comprising a central hub containing lamp ballast means, a plurality of support arms extending radially from said hub and adapted to hold a circular flourescent lamp in a position surrounding said hub, and an elongated resilient electrical connector member having one end thereof fixedly secured in a slot in said hub and extending from said hub substantially alongside one of said support arms and containing electrical wires and having angular socket means at the other end thereof for electrical connection to the base plug of said lamp; said elongated resilient electrical connector member having a rectangular cross-section of which the smaller dimension is in the direction of bending of the connector member when it is connected to or disconnected from said lamp.

2. A lamp unit as claimed in claim 1, in which said one support arm has a rectangular cross-section of which the larger dimension thereof is substantially parallel to and alongside the larger dimension of said connector cross-section.

3. A lamp unit as claimed in claim 2, in which said larger cross-section dimensions of the connector and the support arm are approximately equal.

* * * * *